US007461810B2

(12) United States Patent
Goeking et al.

(10) Patent No.: US 7,461,810 B2
(45) Date of Patent: Dec. 9, 2008

(54) TISSUE ROLL DISPENSER

(75) Inventors: Harold J. Goeking, Oshkosh, WI (US); Gregory D. Budz, Sobieski, WI (US); Michael R. Kilgore, Little Suamico, WI (US); Karl D. Kissinger, Appleton, WI (US); Andy L. Kirkpatrick, Green Bay, WI (US); John R. Moody, Winlock, WA (US)

(73) Assignee: Georgia-Pacifiic Consumer Products LP, Atlanta, GA (US)

( * ) Notice: Subject to any disclaimer, the term of this patent is extended or adjusted under 35 U.S.C. 154(b) by 364 days.

(21) Appl. No.: 11/270,005

(22) Filed: Nov. 9, 2005

(65) Prior Publication Data

US 2006/0102770 A1 May 18, 2006

Related U.S. Application Data

(60) Provisional application No. 60/690,273, filed on Jun. 14, 2005, provisional application No. 60/627,071, filed on Nov. 12, 2004.

(51) Int. Cl.
*A47K 10/24* (2006.01)
*B65H 19/10* (2006.01)

(52) U.S. Cl. ..... 242/559.2; 242/559.1; 242/560

(58) Field of Classification Search ..... 242/559.1, 242/559.2, 559.3, 560, 560.1, 597.8, 599.2
See application file for complete search history.

(56) References Cited

U.S. PATENT DOCUMENTS 1,462,333 A * 7/1923 Girard ..... 242/538
2,930,664 A 3/1960 Liebisch ..... 312/39

(Continued)

FOREIGN PATENT DOCUMENTS

GB 2 245 882 A 1/1992

*Primary Examiner*—Evan H Langdon
(74) *Attorney, Agent, or Firm*—Joel T. Chalton

(57) ABSTRACT

A gravity-feed tissue roll dispenser for a plurality of tissue rolls includes: (a) a housing; (b) a supply turret with a plurality of spindles for mounting a plurality of tissue rolls for dispensing; (c) means for rotatably mounting the supply turret in the housing about a center of rotation such that a vertical line through the center of rotation of the turret defines a biasing sector of the dispenser and the spindles rotate between upper and lower positions, the dispenser also having a dispensing sector adjacent the biasing sector; (d) stop means adapted for securing a loaded spindle in an elevated dispensing position in the dispensing sector of the tissue dispenser, the dispensing position being elevated with respect to a lower limit of travel of the spindle upon rotation of the turret; wherein the stop means are responsive to depletion of the loaded spindle so as to allow rotation of the turret upon depletion of a roll of tissue mounted thereabout; and wherein further the turret and stop means are configured such that when a loaded spindle is secured in the elevated dispensing position: (i) at least two spindles are in the biasing sector of the dispenser and (ii) the number of spindles in the biasing sector is equal to or greater than the number of other spindles of the dispenser, such that when the dispenser is fully loaded with a plurality of like tissue rolls, depletion of a roll in the elevated dispensing position distributes the weight of tissue in the dispenser so as to bias the turret in a dispensing direction.

6 Claims, 17 Drawing Sheets

U.S. PATENT DOCUMENTS

| | | | | | |
|---|---|---|---|---|---|
| 4,108,513 | A | | 8/1978 | Lander | 312/39 |
| 4,557,426 | A | | 12/1985 | Siciliano | 242/55.3 |
| 4,651,910 | A | * | 3/1987 | DeGroot | 225/1 |
| 4,872,601 | A | * | 10/1989 | Sigmund | 225/38 |
| 4,989,800 | A | | 2/1991 | Tritch | 242/55.3 |
| 5,265,816 | A | * | 11/1993 | Collins | 242/560 |
| 5,310,129 | A | | 5/1994 | Whittington et al. | 242/55.3 |
| 5,636,812 | A | | 6/1997 | Conner et al. | 242/559.2 |
| 6,491,251 | B1 | * | 12/2002 | Stanland et al. | 242/559.2 |
| 6,616,087 | B1 | * | 9/2003 | Chern | 242/559.2 |
| 6,648,267 | B2 | | 11/2003 | Stanland et al. | 242/559.2 |
| 6,752,349 | B2 | | 6/2004 | Moody et al. | 242/560 |
| 7,114,676 | B2 | * | 10/2006 | Elliott et al. | 242/559.2 |
| D543,402 | S | * | 5/2007 | Goeking et al. | D6/520 |
| D543,745 | S | * | 6/2007 | Goeking et al. | D6/520 |
| D556,482 | S | * | 12/2007 | Goeking et al. | D6/520 |
| 2002/0050544 | A1 | * | 5/2002 | Stanland et al. | 242/559.2 |

* cited by examiner

TISSUE ROLL DISPENSER

CLAIM FOR PRIORITY

This non-provisional is based upon Provisional Application No. 60/627,071 filed Nov. 12, 2004 and Provisional Application No. 60/690,273 filed Jun. 14, 2005. The priorities of the foregoing applications are hereby claimed and the disclosures thereof are incorporated into this application by reference in their entireties.

TECHNICAL FIELD

The present invention relates generally to dispensers for rolls of tissue. A preferred embodiment is a four-roll, gravity-feed roll dispenser for tissue rolls.

BACKGROUND

Dispensers for tissue rolls are well known in the art. There is shown, for example, in U.S. Pat. No. 6,752,349 to Moody et al. a tissue dispenser for two rolls of coreless tissue. The dispenser includes a support sled for mounting the rolls. The support sled is provided with latch dog assemblies which are biased towards a release position such that a second roll will become available when a first coreless tissue roll is depleted. The dispenser of the '349 patent accommodates two rolls; in many cases more capacity is desired.

Other dispensers have been proposed for three or more rolls. There is disclosed in U.S. Pat. No. 5,310,129 to Whittington et al. a dispenser for sequentially dispensing rolls of tissue. The dispenser includes a support having a housing with an opening. A roll holder is rotatably mounted on the support and has three spaced roll support shafts or spindles which are inserted into rolls. The roll holder and rolls are maintained in an unbalanced condition to sequentially present the rolls at a dispensing position under the influence of gravity.

Another three roll dispenser is seen in U.S. Pat. No. 5,636,182 to Conner et al. The dispenser of the '812 patent is similar in most respects to that of the '129 patent mentioned above; however, the dispenser has a limiting gate position to impede rotation of a roll mounting turret when a roll is full.

One drawback of three roll gravity-feed dispensers is that in order to maintain an unbalanced condition favoring advancement in a dispensing direction, only two of three available mounting posts are filled with material. Otherwise, the load (apart from the roll being dispensed) is generally symmetrically distributed about a vertical bisecting the turret of the dispenser and the rolls thus have insufficient gravity bias to be reliably advanced. See the '812 patent at FIGS. 2-4 and note the disclosure at Col. 3, lines 21 and following. Additional dispensers are seen in the following: British Patent No. 2,245,882 to Crisp et al.; U.S. Pat. No. 6,648,267 to Stanland et al. Further features may be found in the following: U.S. Pat. No. 4,989,800 to Tritch; U.S. Pat. No. 4,108,513 to Lander; U.S. Pat. No. 4,557,426 to Siciliano and U.S. Pat. No. 2,930,664 to Liebisch.

High capacity dispensers are especially desirable for commercial establishments. Three roll dispensers inherently require incomplete loading for reliable operation by way of gravity. One existing solution is the use of very high capacity, large diameter (up to 1 ft or so in diameter) single rolls; however these rolls are difficult to handle and load into the dispenser. Moreover, large roll dispensers are either without reserve rolls or are difficult to operate and re-load; a condition leading to the unavailability of tissue when needed.

SUMMARY OF THE INVENTION

There is provided in accordance with the invention a high capacity dispenser for tissue rolls having a distribution of reserve rolls which favor advancement of a dispensing turret in a dispensing direction when the dispenser is fully loaded. A gravity-feed tissue roll dispenser for a plurality of tissue rolls includes: (a) a housing; (b) a supply turret with a plurality of spindles for mounting a plurality of tissue rolls for dispensing; (c) means for rotatably mounting the supply turret in the housing about a center of rotation such that a vertical line through the center of rotation of the turret defines a biasing sector of the dispenser and the spindles rotate between upper and lower positions, the dispenser also having a dispensing sector adjacent the biasing sector; (d) stop means adapted for securing a loaded spindle in an elevated dispensing position in the dispensing sector of the tissue dispenser, the dispensing position being elevated with respect to a lower limit of travel of the spindle upon rotation of the turret; wherein the stop means are responsive to depletion of the loaded spindle so as to allow rotation of the turret upon depletion of a roll of tissue mounted thereabout; and wherein further the turret and stop means are configured such that when a loaded spindle is secured in the elevated dispensing position: (i) at least two spindles are in the biasing sector of the dispenser and (ii) the number of spindles in the biasing sector is equal to or greater than the number of other spindles in the dispensing sector, such that when the dispenser is fully loaded with a plurality of like tissue rolls, depletion of a roll in the elevated dispensing position distributes the weight of tissue in the dispenser so as to bias the turret in a dispensing direction. In a preferred embodiment, the stop means include a plurality of release arms which are mounted on the turret and biased toward a release position, the release arms being further adapted to be compressed to a locking position when the spindle is loaded with a coreless or other suitable tissue roll. The release arms are pivotally mounted and adapted to engage the end of a tissue roll loaded onto an associated spindle whereby the arms are compressed to their locking positions; to this end the release arms have terminal portions gapped with an associated spindle a predetermined distance such that the release arm will assume its release position upon depletion of a tissue roll loaded onto its associated spindle. Preferably, the terminal portions of the release arms are generally arcuate such that a gap between a release arm and its associated spindle is of generally uniform width in the locking position of the release arm. The release arms have latch projections mounted thereon configured to cooperate with a locking shoulder on a back plate upon which the supply turret is mounted in order to secure the turret in the dispensing position.

In a preferred embodiment, the dispenser further comprises means for manually advancing the turret in a dispensing direction, such as wherein the turret has gear teeth about its periphery and the means for manually advancing the turret include a geared advancing wheel which engages the gear teeth of the turret. Preferably, the advancing wheel is mounted on a one-way bearing and has a molded-in direction indicator. So also, the dispenser typically includes means for preventing rotation of the turret in a direction opposite the dispensing direction.

Generally speaking, the housing of the dispenser includes a back plate, a cover hinged thereto and optionally locking means for securing the cover to the back plate in a locking position. The locking means may include a latch member mounted in a cavity in the back plate and the latch member may be an injection-molded part which includes integrally formed biasing projections bearing upon surfaces of the cavity to urge the latch member to a locking position.

A line from the spindle secured in the dispensing position to an opposed spindle in the biasing sector of the dispenser typically makes an angle, at, of from about 10° to about 30° with a vertical passing through the center of rotation of the turret.

In one preferred embodiment, the means for rotatably mounting the supply turret in the housing comprises a mandrel with a stepped profile and the supply turret comprises a mounting wheel and a retaining plate each of which have molded-in features for securing them to each other. The mounting wheel and retaining plate may be rotationally lockable to each other along a relative locking direction co-directional with a dispensing direction in which the turret rotates to supply additional product. The mounting plate has a plurality of release arms provided with biasing means and the retaining plate is adapted to secure the biasing means of the release arms to the mounting plate of the turret, thereby eliminating the need for additional hardware.

A preferred construction is a gravity-feed tissue roll dispenser for tissue rolls comprising: (a) a housing; (b) a supply turret with four equally spaced of spindles for mounting tissue rolls for dispensing; (c) a back plate for rotatably mounting the supply turret in the housing about a center of rotation such that a vertical line through the center of rotation of the turret divides the dispenser into a biasing sector and a dispensing sector, the spindles being mounted to rotate between upper and lower positions; and (d) stop means adapted for securing a loaded spindle in an elevated dispensing position in the dispensing sector of the tissue dispenser, the dispensing position being elevated with respect to a lower limit of travel of the spindle upon rotation of the turret; wherein the stop means are responsive to depletion of the loaded spindle so as to allow rotation of the turret upon depletion of a roll of tissue mounted thereabout; the dispensing position of a loaded spindle being further characterized in that two spindles are in the biasing sector of the dispenser and two spindles are in the dispensing sector of the dispenser and a line between the loaded spindle in the dispensing position and an opposed spindle in the biasing sector defines an angle, $\alpha$, of from about 10° to about 30° with respect to a vertical line through the center of rotation of the turret; and wherein further the turret and stop means are configured such that when the dispenser is fully loaded with a plurality of like tissue rolls, depletion of a roll in the elevated dispensing position distributes the weight of tissue in the dispenser so as to bias the turret in a dispensing direction. Typically, the angle, $\alpha$, is from about 15° to about 25°; preferably, the angle, $\alpha$, is about 18°.

In another aspect of the invention, there is provided a gravity-feed tissue roll dispenser for a plurality of tissue rolls comprising: (a) a housing with a dispensing opening for allowing access to tissue contained in the dispenser; (b) a supply turret with a plurality of spindles for mounting a plurality of tissue rolls for dispensing; (c) means for rotatably mounting the supply turret in the housing; (d) stop means adapted for securing a loaded spindle in a dispensing position, the stop means being responsive to depletion of the loaded spindle so as to allow rotation of the turret upon depletion of a roll of tissue mounted thereabout; and (e) a plurality of sequestering members mounted on the turret and associated with the spindles, each sequestering member being adapted to cooperate with the housing in order to hinder access to a tissue roll on its associated spindle until the spindle is in the dispensing position. Preferably, the means for rotatably mounting the supply turret in the housing are configured to mount the turret about a center of rotation such that a vertical line through the center of rotation of the turret defines a biasing sector of the dispenser and the spindles rotate between upper and lower positions, the dispenser also having a dispensing sector adjacent the biasing sector, and wherein the dispensing position is elevated with respect to a lower limit of travel of the spindle upon rotation of the turret. The turret and stop means are configured such that when a loaded spindle is secured in the elevated dispensing position: (i) at least two spindles are in the biasing sector of the dispenser and (ii) the number of spindles in the biasing sector is equal to or greater than the number of other spindles in the dispensing sector, such that when the dispenser is fully loaded with a plurality of like tissue rolls, depletion of a roll in the elevated dispensing position distributes the weight of tissue in the dispenser so as to bias the turret in a dispensing direction. In preferred constructions, the sequestering members have plates are curved plates and may be discrete components or the sequestering plates are injection-molded as part of a unitary structure.

Another aspect of the invention involves (a) dispensing a plurality of tissue rolls in a dispenser of the invention and (b) withdrawing the tissue from the dispenser.

Still other features and advantages of the invention will become apparent from the discussion which follows.

BRIEF DESCRIPTION OF THE DRAWINGS

The invention is described in detail below with reference to the drawings, wherein like numerals designate similar parts. In the drawings.

DETAILED DESCRIPTION

Figure 1:
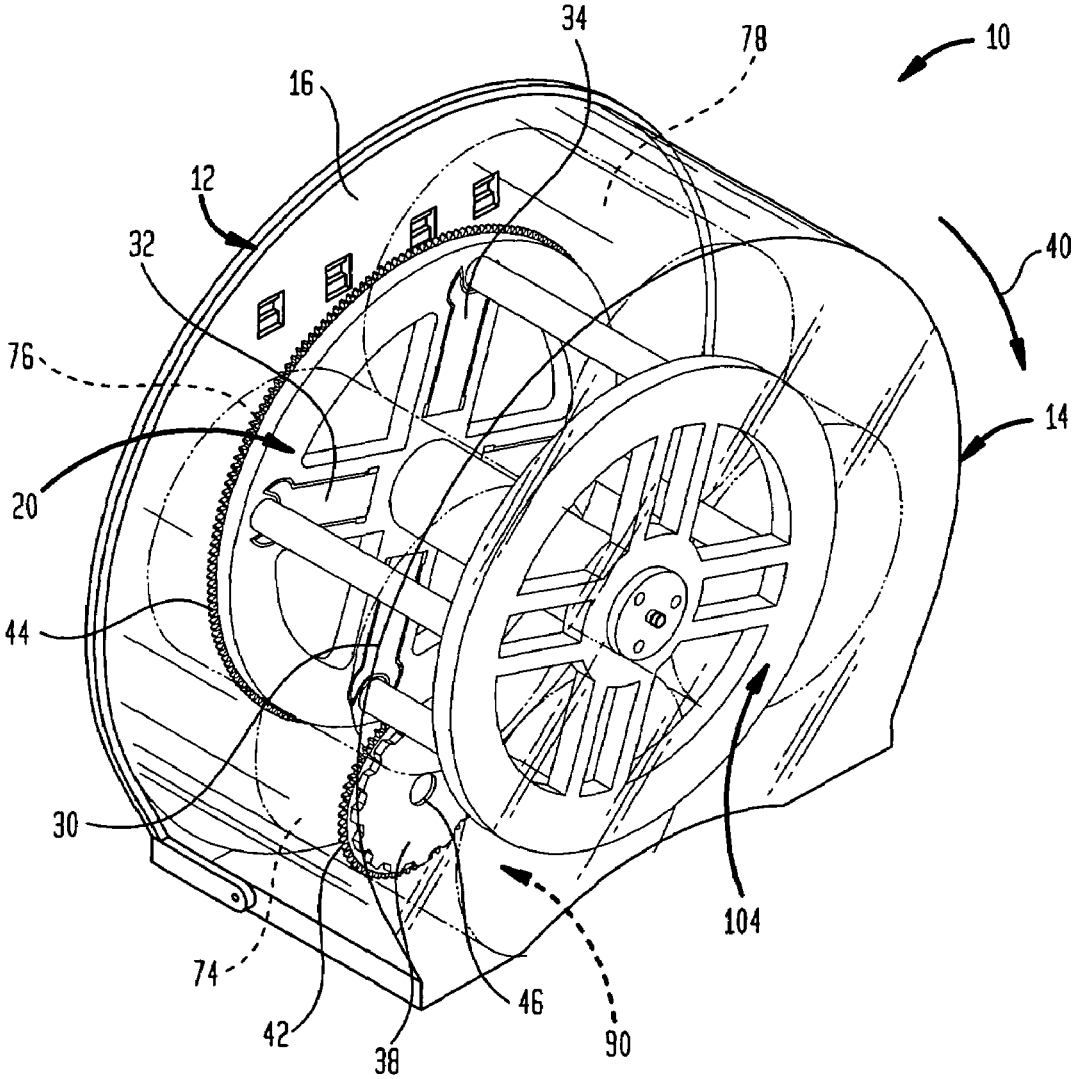
FIG. 1 is a perspective view of a first embodiment of the inventive dispenser provided with 4 rolls of coreless tissue.

The invention is described in detail below with reference to the figures for purposes of illustration only. Modifications within the spirit and scope of the present invention, set forth in the appended claims, will be readily apparent to those of skill in the art.

It will be appreciated from the following discussion that a preferred embodiment is a dispenser for four rolls of tissue arranged at equally spaced intervals on a circular turret. When at rest, there is an 18° offset from vertical of the center line of the bottom most and top most rolls of tissue. This offset from vertical places more weight on the right side (biasing sector) of the dispenser as viewed from the front which provides for gravity to automatically advance the rolls in a clockwise manner when the roll in use is consumed. That is to say, when a roll is fully consumed a release arm raises from its compressed position to travel over a stop shoulder on the back plate.

The rolls are trapped or secured by the inside of the cover keeping the release arms in a compressed state which does not allow the turret or rotary plate to move past a target roll for dispensing. As the roll is depleted its outside diameter is reduced until such time as the outside diameter is less than double the radius at the end of the release arm (in the case where the release arm has a semi-circular end). Once this outside diameter is reached there is nothing to hold the release arm in a compressed position and it is raised by its associated spring—no longer engaging the stop on the back plate. When this occurs gravity causes the rotating plate to rotate clockwise due to the redistributed weight of tissue until the next roll is in position with its release arm (in a locking position) engaged with the stop on the back plate. Details and other features of the invention will be appreciated by way of reference of FIGS. 1 through 10.

There is illustrated in the various figures a dispenser 10 including a housing 12 with a cover 14. Dispenser 10 has a back plate 16 with a mandrel 18 for mounting a turret 20.

Turret 20 has a cylindrical support 19 for mounting the turret on mandrel 18 of back plate 16 as well as four spindles, spindle 22, spindle 24, spindle 26, and spindle 28. Each spindle has a release arm such as release arms 30, 32, 34, and 36 associated therewith. Operation of the release arms will be further appreciated from the discussion below. Other features of the dispenser generally include an advancing wheel 38 for manually advancing turret 20 along a dispensing direction 40. To this end, advancing wheel 38 has gear teeth 42 which engage another set of gear teeth 44 on turret 20. Advancing wheel 38 is mounted on a one way bearing indicated at 46 which prevents the turret from rotating opposite dispensing direction 40.

When necessary, advancing wheel 38 is rotated in direction 48 i.e., a counter-clockwise direction in order to advance turret 20 in the dispensing direction. Otherwise, the one-way bearing indicated at 46 will prevent unwanted rotation of supply turret 20 as noted above by way of inter-engagement of the gear teeth.

Other features of the dispenser include a latching member 50 having two arcuate spring portions 52 and 54. Latching member 50 is adapted to be mounted in a cavity of back plate 16 as shown having a plurality of surfaces adapted to engage springs 52 and 54 so that the latching member is urged to a locking position by action of springs 52, 54 on surfaces such as surfaces 58 and 60. Latching member 50 is preferably of unitary construction; such as being injection molded and may be made from an engineering resin such as polyacetal, nylon, polyester or the like.

Figure 4:
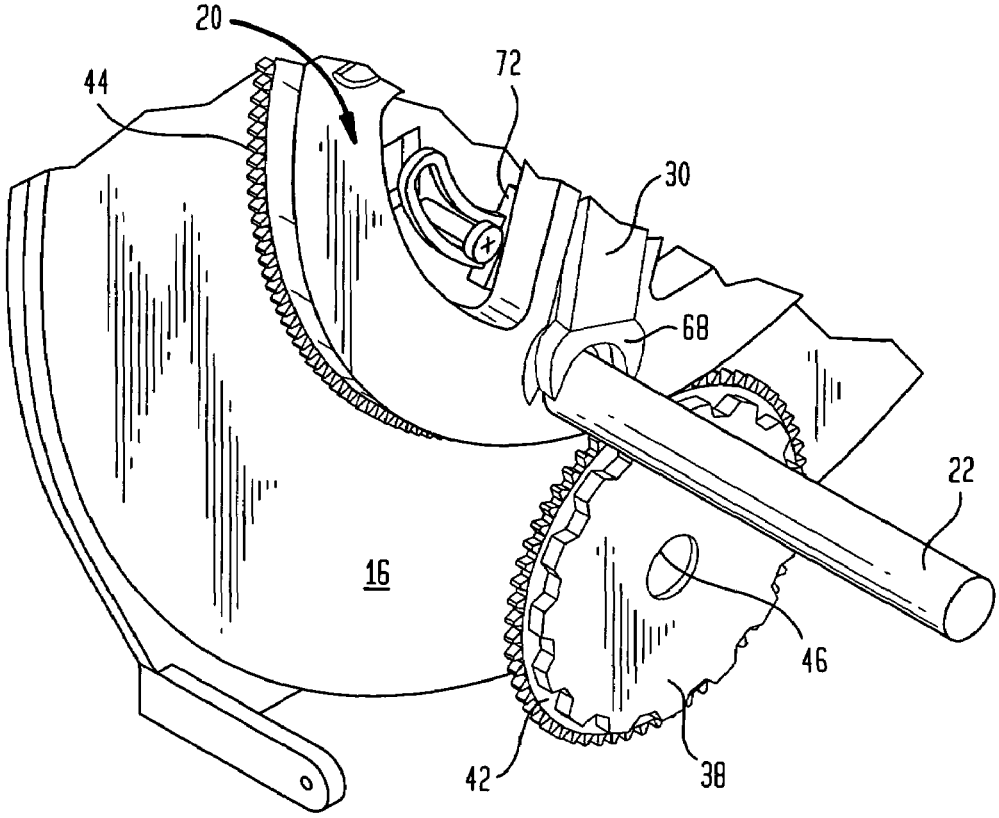
FIG. 4 is an enlarged detail in perspective showing a spindle and release arm of the mounting turret of the dispenser of FIG. 1 also showing a manual advance wheel.
Figure 5:
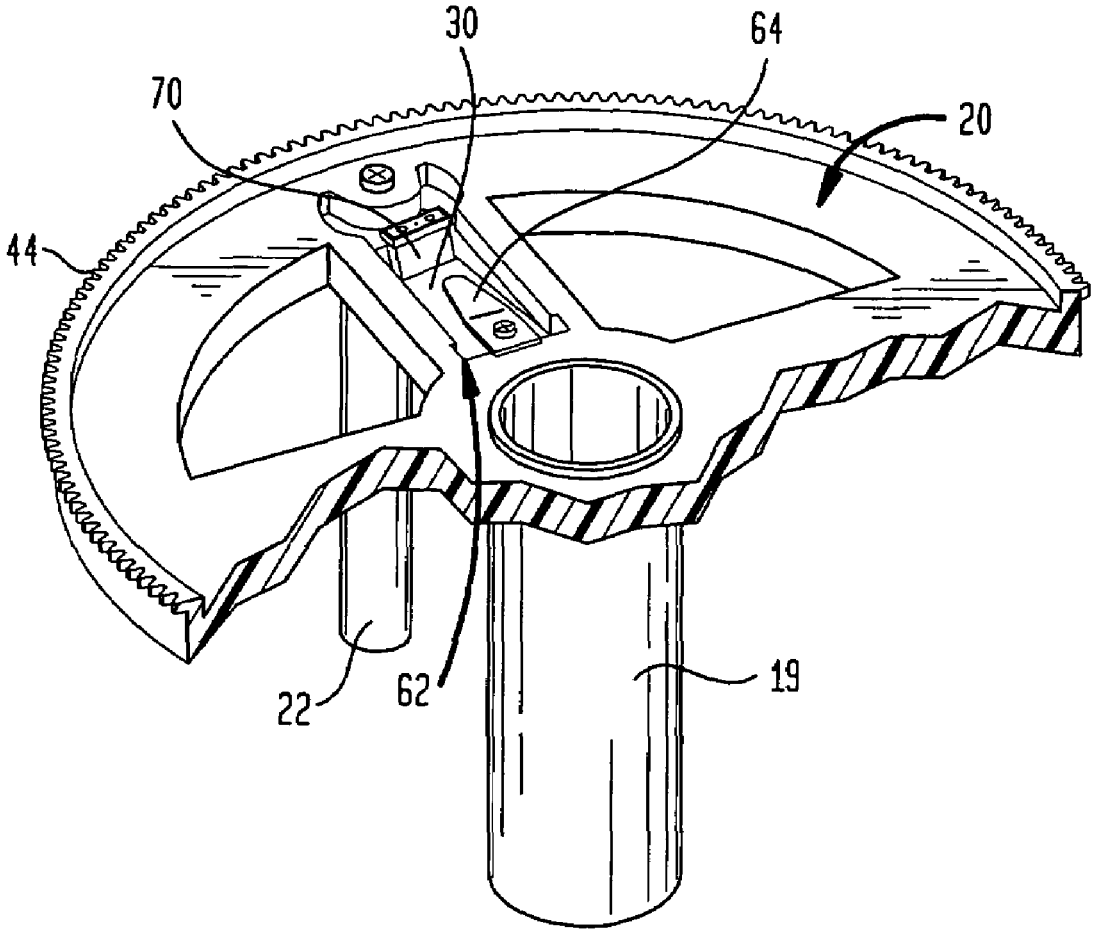
FIG. 5 is an enlarged rear perspective view of the turret of the dispenser showing a release arm and associated spring of the release arm.
Figure 6:
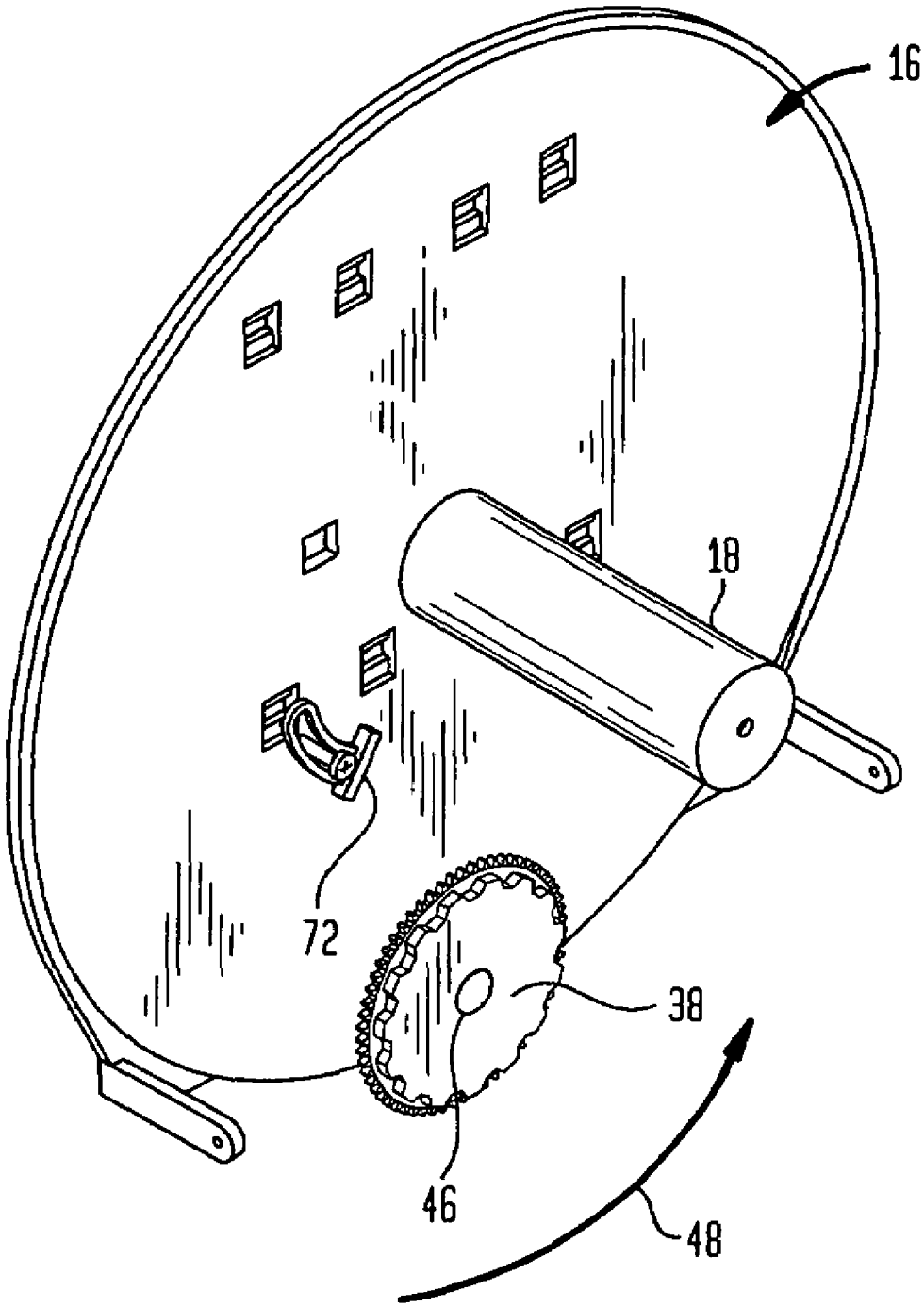
FIG. 6 is a front perspective view of the back mounting plate of the dispenser.
Figure 7:
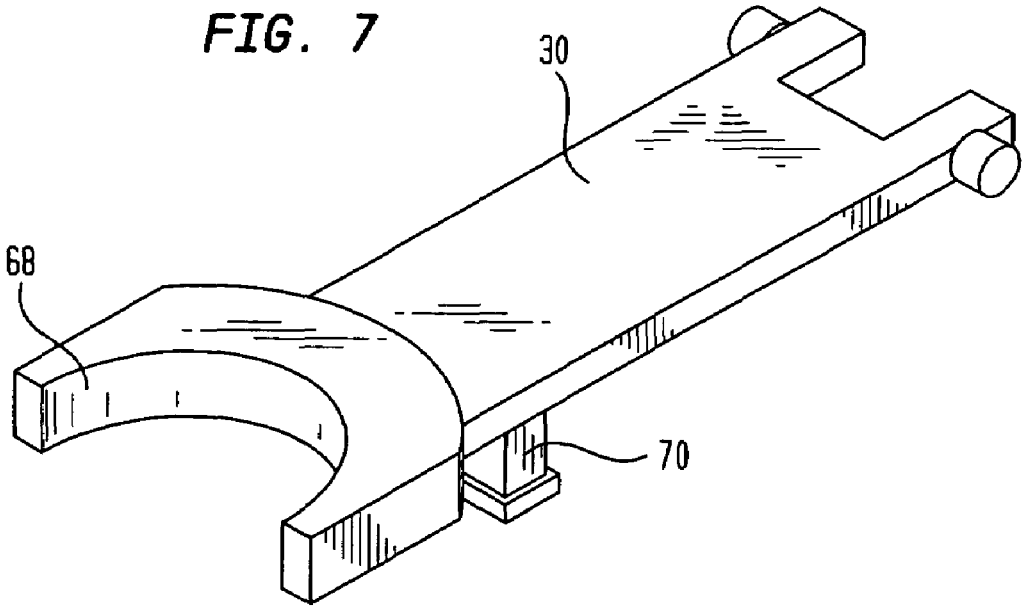
FIG. 7 is a top perspective view of a release arm.
Figure 8:
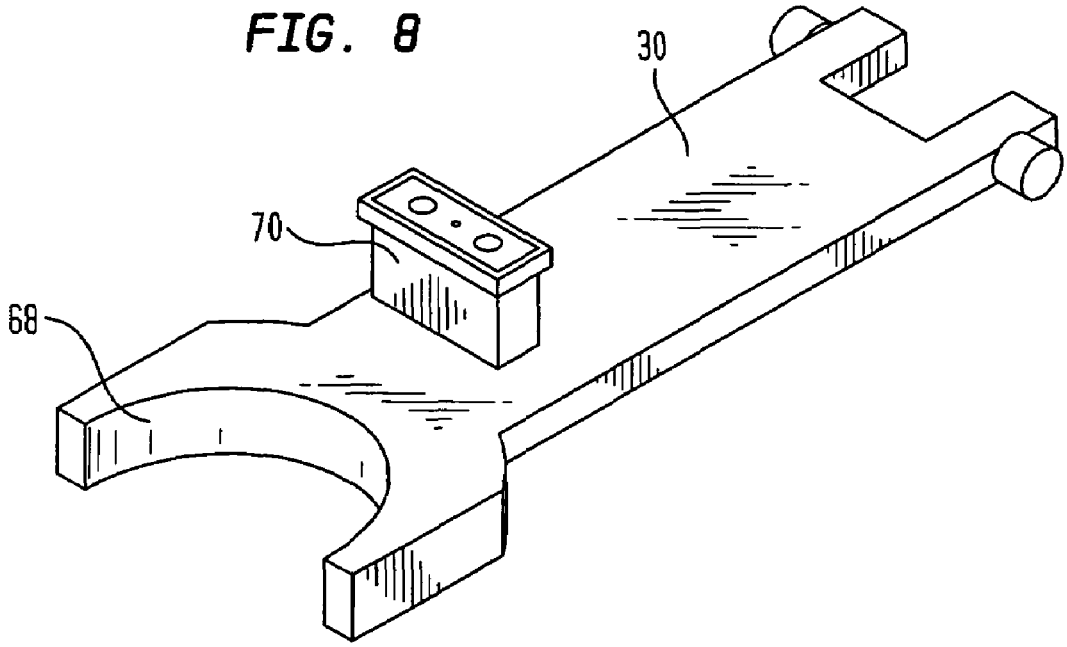
FIG. 8 is a bottom perspective view of a release arm.
Figure 9:
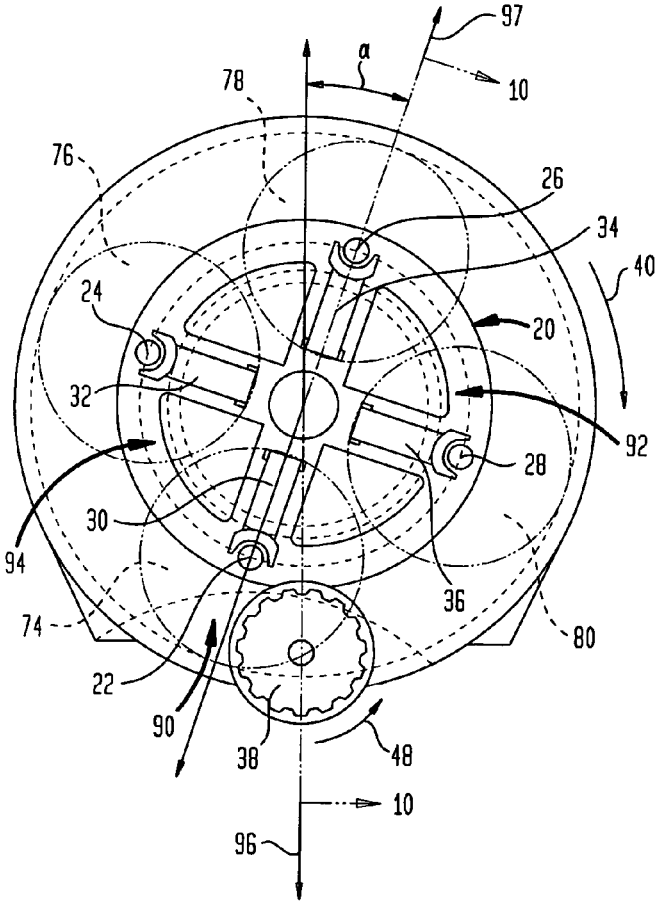
FIG. 9 is a front view schematic diagram illustrating operation of the dispenser of FIG. 1.
Figure 10:
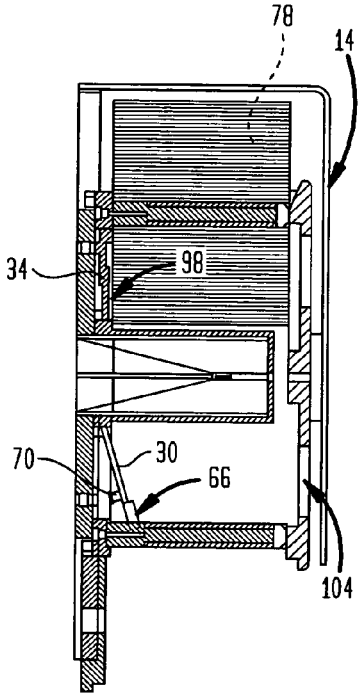
FIG. 10 is a side view schematic diagram illustrating operation of the dispenser of FIG. 1, along line 10-10 of FIG. 9, wherein roll 74 has been depleted.

Preferably, the release arms are pivotably mounted in turret 20 by way of a hinge 62 (FIG. 5) and each include a spring 64 to bias the release arms to an unlocked position such as is shown on the lower portion of FIG. 10 at 66. The release arms generally have the features shown in FIGS. 4, 5, 7 and 8. It can be seen from the various figures that each release arm has an arcuate terminal portion 68 as well as a latch projection 70 adapted to cooperate with a locking shoulder 72 of back plate 16 (FIG. 6). The release arms have an arcuate end 68 as noted above such that it is gapped with its associated spindle as is seen in FIGS. 4 and 5. It will be appreciated from the various diagrams, that when the release arms are compressed to their locking positions, i.e., fully towards the back plate, the arcuate end of the release arms define a gap of generally uniform width between the release arm and the spindle. Operation of the dispenser is perhaps best appreciated by reference to FIGS. 1, 9 and 10.

The dispenser when fully loaded, is adapted to hold four rolls on spindles 22, 24, 26 and 28, for example, roll 74, roll 76, roll 78, and roll 80 as is shown in the various Figures. When a roll is in the dispensing position, indicated at 90 in FIGS. 1 and 9, two of the rolls of a fully loaded dispenser rolls 78 and 80 are mounted on spindles in a biasing sector 92 of the dispenser while rolls 74 and 76 are mounted in a dispensing sector 94 of the dispenser. The various sectors are defined by a vertical line 96 passing through the centre of mandrel 18 that is to say, passing through the center of rotation of turret 20. In the embodiment shown, the sector of the dispenser to the right of line 96 maybe thought of as the biasing sector and the area to the left of line 96 may be thought of as the dispensing sector of the dispenser. See FIG. 9.

Note further that a line 97 between spindles 22 and 26 defines an angle a with line 96 where a may be anywhere from about 10 to about 30° in preferred embodiments.

When roll 74 is depleted the distribution of tissue weight of a fully loaded dispenser shifts to the biasing sector 92.

Further, when roll 74 is depleted (FIG. 10), release arm 30 springs from its locking position, i.e., compressed position, as in FIG. 1 and as shown at 98 in the upper part of FIG. 10 to a release or unlocked position shown at 66 in FIG. 10. As shown at 66 in FIG. 10, latch projection 70 no longer engages locking shoulder 72 of back plate 16 when the release arm is in its unlocked or release position. The turret 20 is now free to rotate in dispensing direction 40 under the influence of gravity due to the weight distribution of tissue in the dispenser. Thus, turret 20 advances automatically under the influence of gravity until roll 80 is locked into position by virtue of its release arm interacting with locking shoulder 72.

Note in FIG. 9 that dispensing position 90 is elevated with respect to the lower limit of travel of spindle 22, i.e., that is, when spindle 22 is coincident with vertical line 96. Thus when roll 74 is depleted the biasing force that is the weight of tissue in the biasing sector has a magnified effect on inducing rotation of turret 20 in the desired direction.

The process continues until all the rolls of the dispenser are consumed or the dispenser is reloaded prior to consumption of all of the rolls. In this regard it is noted that the one-way bearing on advancing wheel 38 will prevent rotation of turret 20 opposite to the dispensing direction.

Various means may be used for holding rolls such as roll 74, 76, 78 and 80 on turret 20. For example, one may have a retaining member 104 affixed to cover 14 such that the rolls are pressed down against the release arms when the cover is closed as is shown in FIG. 1. Other modifications of the dispenser are likewise possible. It should be appreciated that a salient feature of the invention is a plurality of rolls mounted in the biasing sector for distributing the weight of tissue for automatic advancement along the dispensing direction.

Further improvements of the invention are illustrated in FIGS. 11 through 20.

In FIGS. 11-19 there is shown another dispenser 110 including a housing 112 with a cover 114. Dispenser 110 has a back plate 116 with a mandrel 118 for mounting a turret 120.

Figure 2:
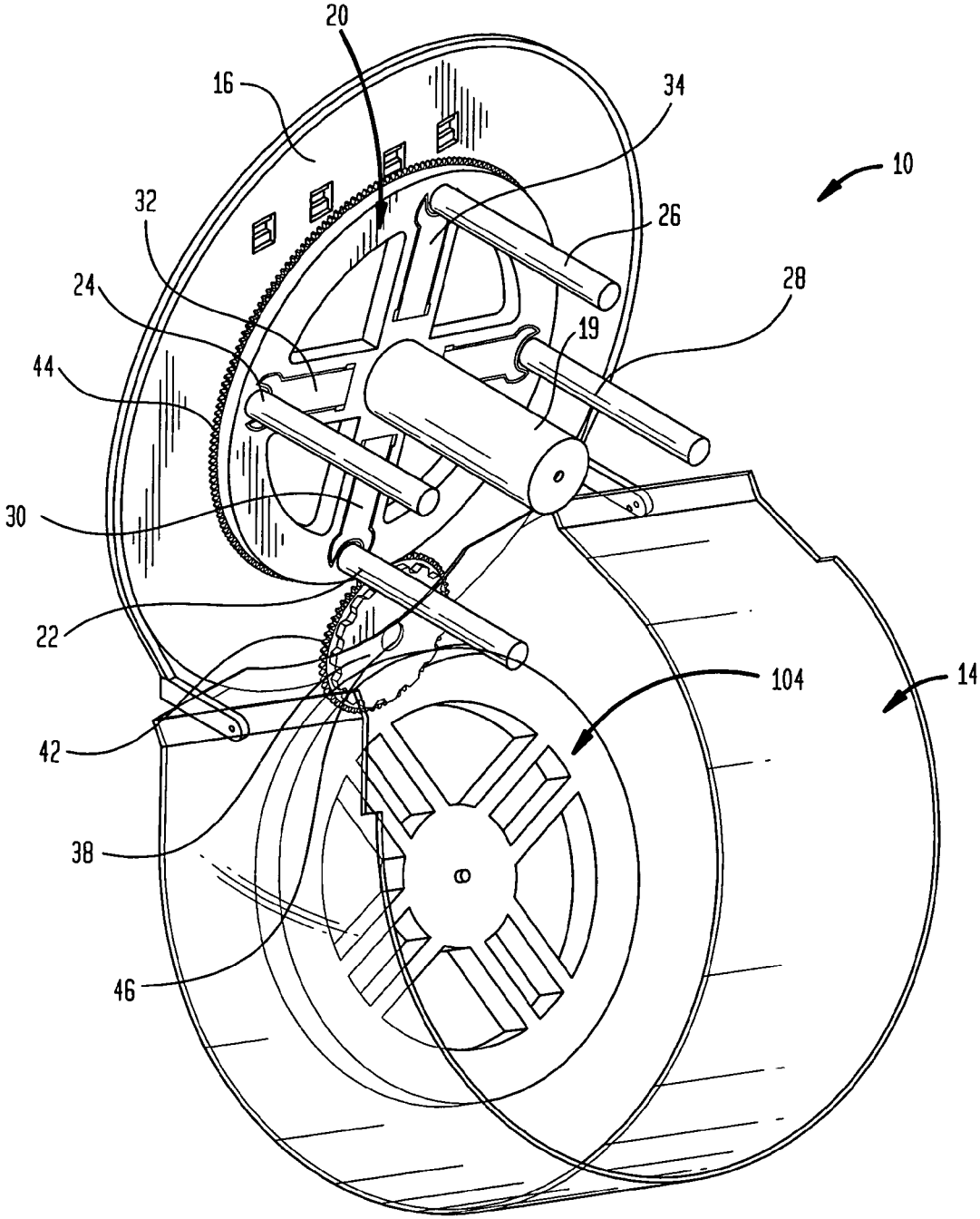
FIG. 2 is a perspective view of the dispenser of FIG. 1 with the cover open and without tissue rolls.
Figure 3:
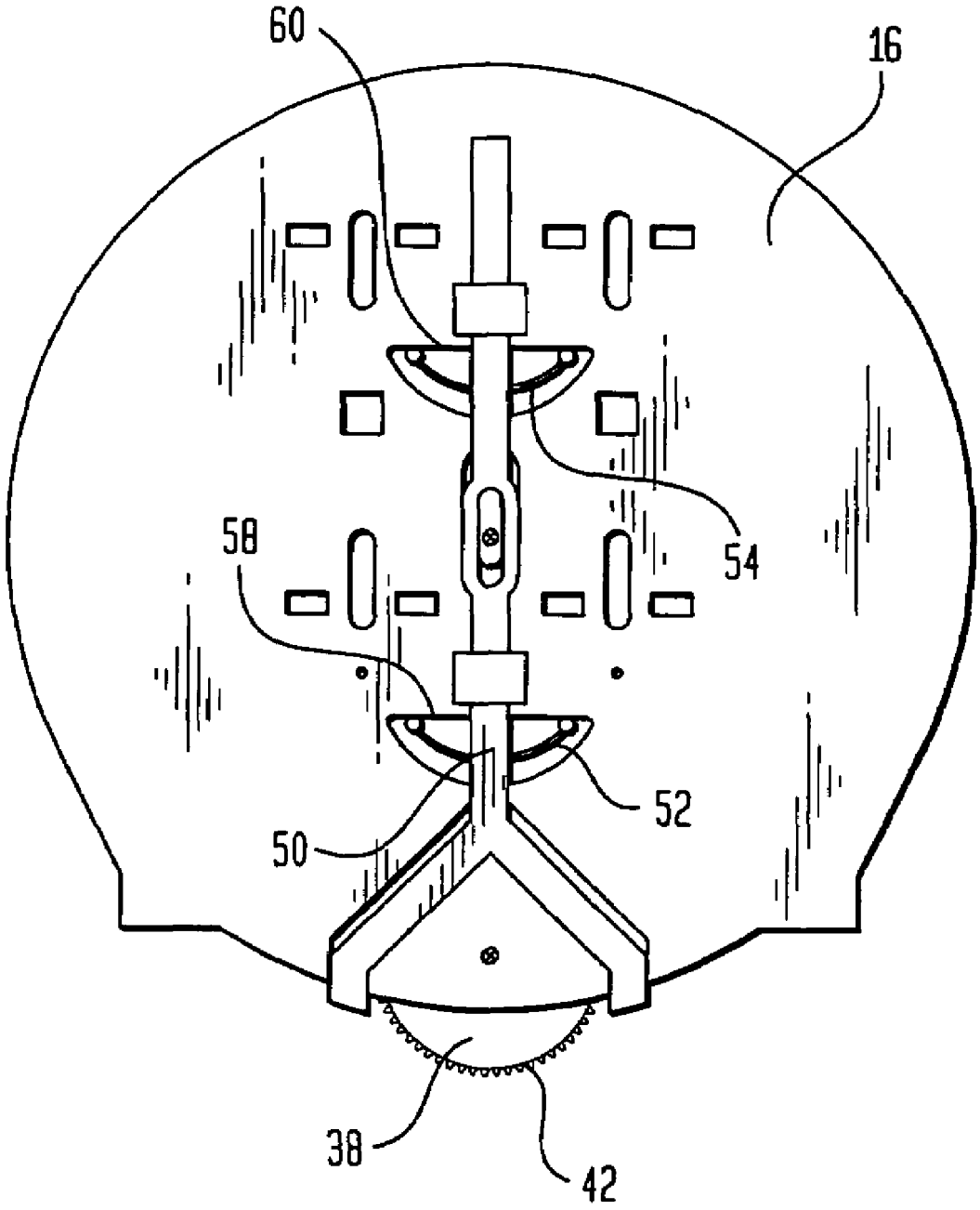
FIG. 3 is a rear view of the dispenser of FIG. 1 showing a dispenser locking mechanism.

Turret 120 has a cylindrical support 119 for mounting the turret on mandrel 118 of back plate 116 as well as four sleeved spindles, spindle 122, spindle 124, spindle 126, and spindle 128. Each sleeved spindle has a release arm such as release arms 130, 132, 134, and 136 associated therewith. Operation of the release arms will be appreciated from the discussion above with respect to corresponding parts of dispenser 10. While "pin" spindles of the type shown and described in connection with FIGS. 2, 4 are adequate for tissue rolls which have a core of paperboard, the sleeved spindles of the embodiment of FIGS. 11-19 are much preferred for coreless rolls because the sleeve will rotate independently of its central support and will provide for smooth dispensing even if the coreless roll tissue tightens around the sleeve.

Other features of the dispenser generally include an advancing wheel 138 for manually advancing turret 120 along a dispensing direction 140. To this end, advancing wheel 138 has gear teeth 142 which engage another set of gear teeth 144 on turret 120. Advancing wheel 138 is mounted on a one way bearing indicated at 146 which prevents the turret from rotating opposite dispensing direction 140.

When necessary, advancing wheel 138 is rotated in direction 148 i.e., a counter-clockwise direction in order to advance turret 120 in the dispensing direction. Otherwise, the one-way bearing indicated at 146 will prevent unwanted rotation of supply turret 120 as noted above by way of interengagement of the gear teeth.

Other features of the dispenser include a latching member 150 having two arcuate spring portions 152 and 154. Latching member 50 is adapted to be mounted in a cavity of back plate 116 as shown having a plurality of surfaces adapted to engage springs 152 and 154 so that the latching member is urged to a locking position by action of springs 152, 154 on surfaces such as surfaces 158 and 160. Latching member 150 is preferably of unitary construction; such as being injection molded and may be made from an engineering resin such as polyacetal, nylon, polyester or the like.

Preferably, the release arms are pivotably mounted in turret 120 by way of a hinge and each include a spring to bias the release arms to an unlocked position such as is shown on the lower portion of FIG. 10 at 66. The release arms generally have the features shown and described above in connection with FIGS. 4, 5, 7 and 8.

Dispenser 110 operates generally as described above in connection with dispenser 10 of FIGS. 1-10. Various improvements include a plurality of sequestering members 180, 182, 184, 186 associated respectively with spindles 122, 124, 126, 128. The members include curved plates and are configured and disposed on turret 120 to cooperate with housing 112 in order to hinder access to rolls of tissue disposed on the spindles until the spindles are in a dispensing position indicated at 190. That is to say, the members 180-186 block access through opening 195 in housing 112 to tissue rolls when they are not in dispensing position 190, such as when they are in biasing sector 192.

Figure 12:
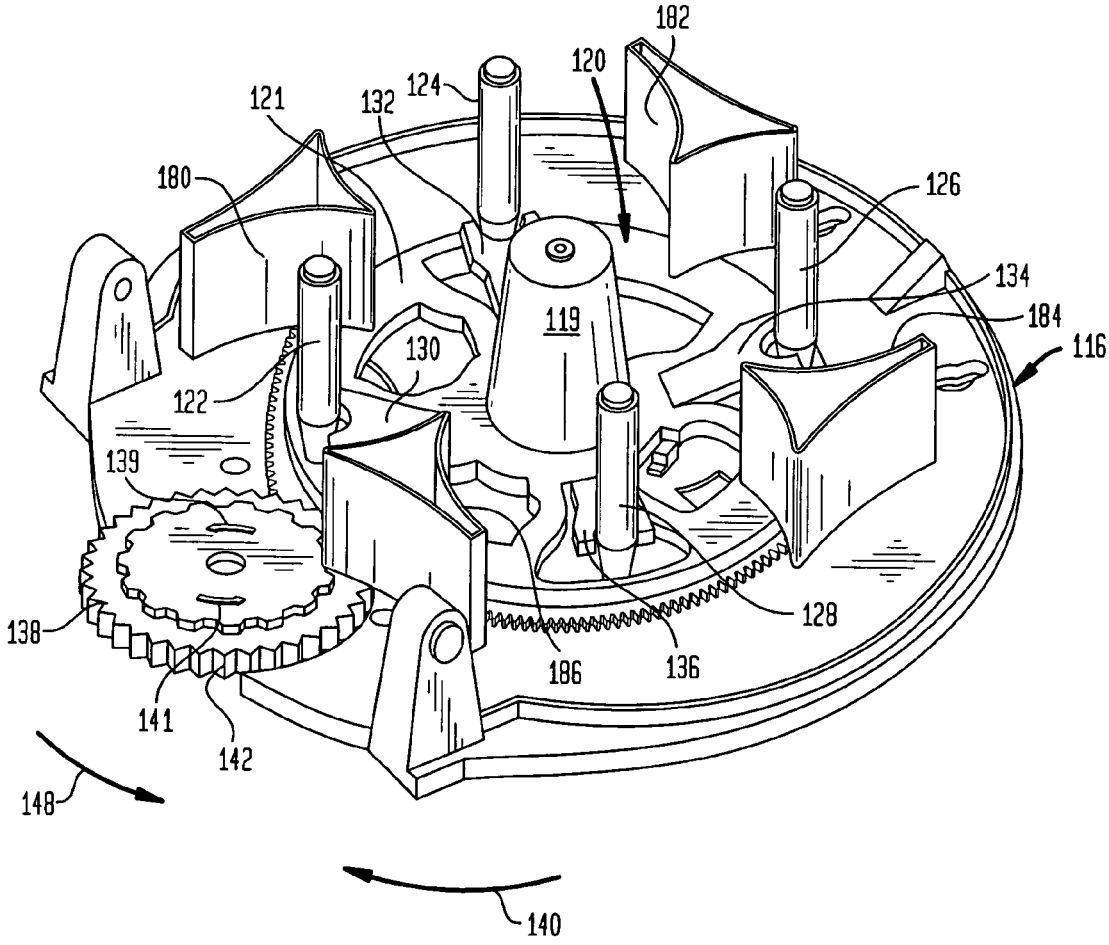
FIG. 12 is a view in perspective showing the turret and back plate assemblies of the dispenser of FIG. 11.
Figure 13:
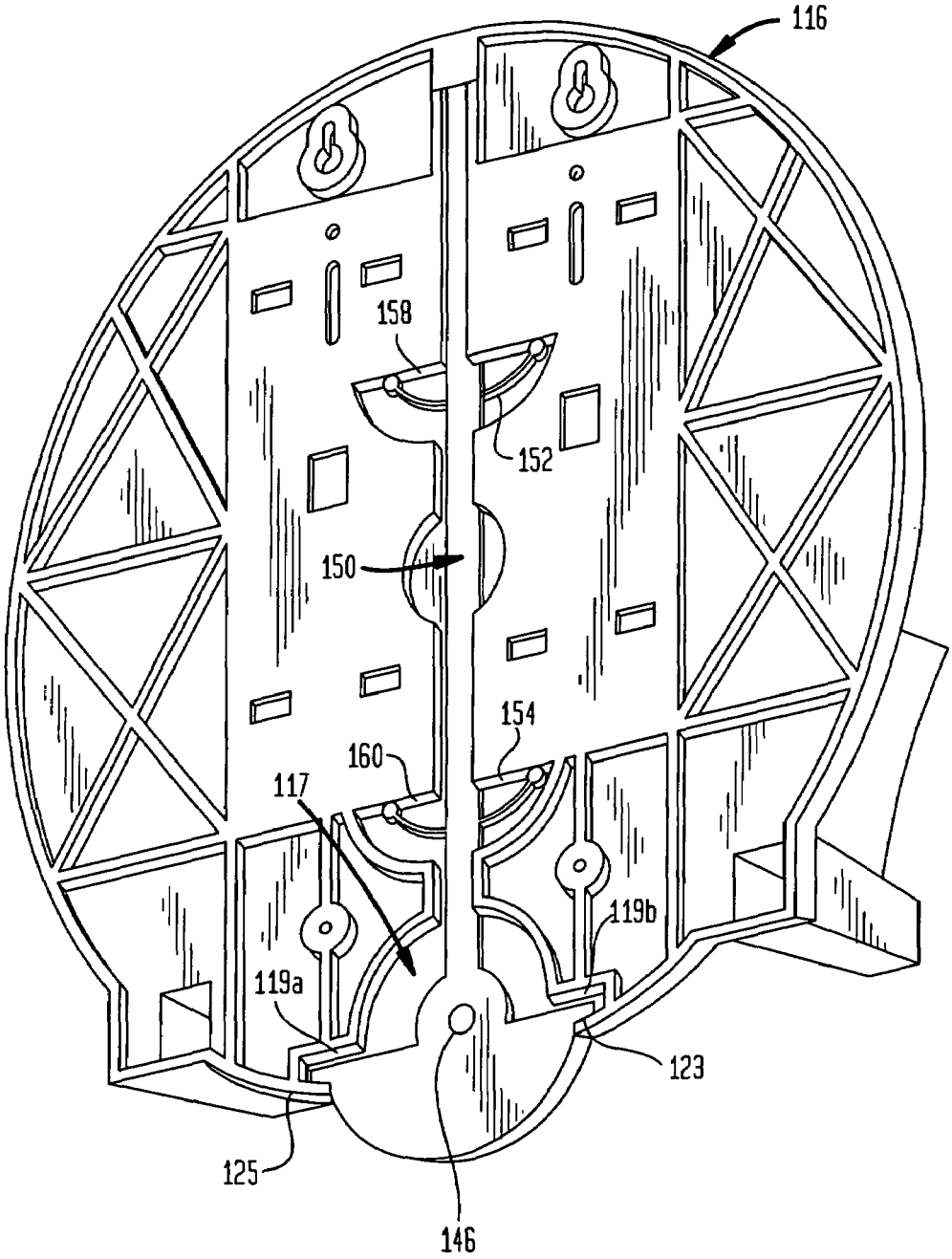
FIG. 13 is a back view in perspective of the assembly of FIG. 12.
Figure 15:
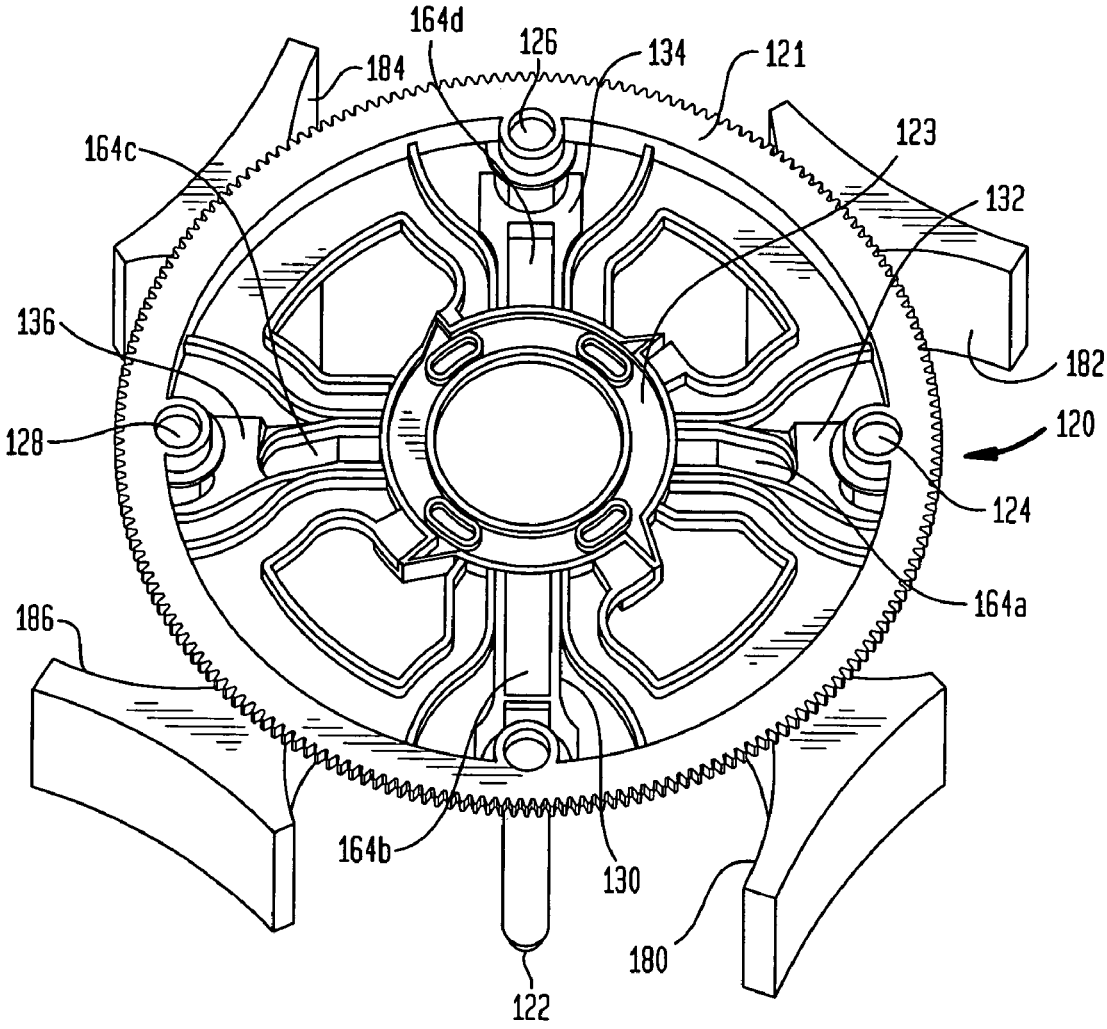
FIG. 15 is a bottom view in perspective of the turret assembly of the dispenser of FIG. 11.
Figure 16:
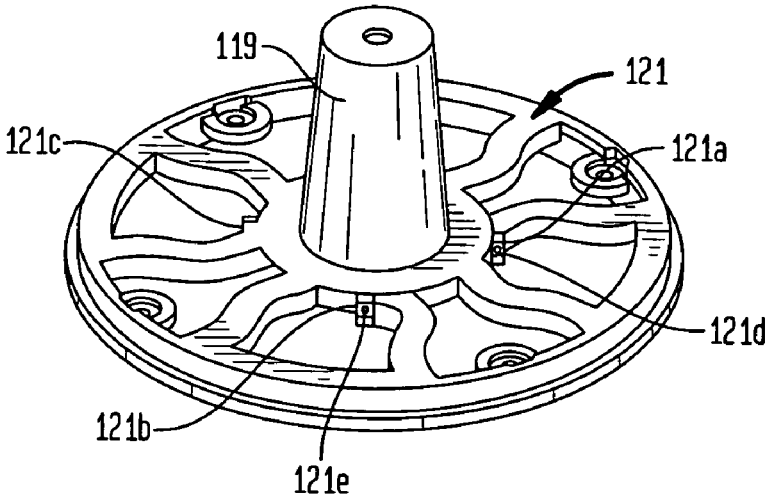
FIG. 16 is a top view in perspective of the mounting wheel of the turret assembly of the dispenser of FIG. 11.
Figure 17:
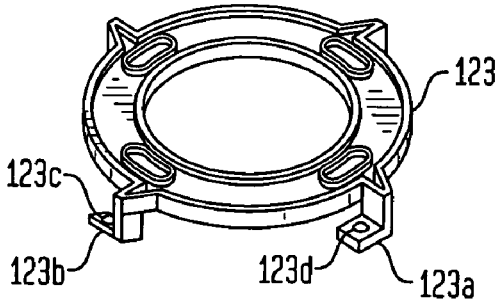
FIG. 17 is a bottom perspective view of a retaining plate of the turret assembly of the dispenser of FIG. 11.
Figure 20:
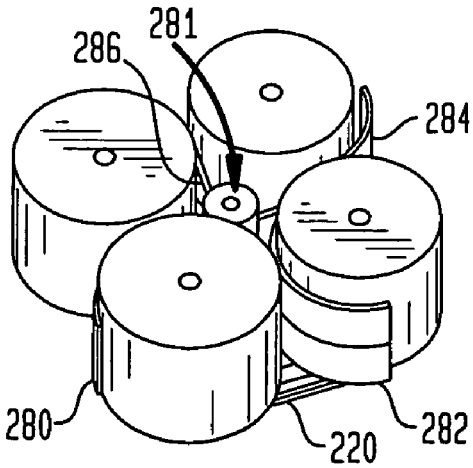
FIG. 20 is a view in perspective illustrating construction of a unitary, injection-molded sequestering plate arrangement which may be used in accordance with the present invention.

Preferably, the sequestering plates have curved plates and may be discrete components as shown in FIGS. 12, 13 and 15. Alternatively, the plates may be put on an injection-molded unitary structure as is shown in FIG. 20.

Further improvements are seen in FIG. 13 which is a perspective view of the back of back plate 116. Plate 116 includes a cavity 117 provided with shoulders 119*a*, 119*b*, 123, 125 to limit travel of latching member 150 such that it does not interfere with wheel 138, especially in the home position when the latch member is urged outwardly by springs 152, 154.

Figure 19:
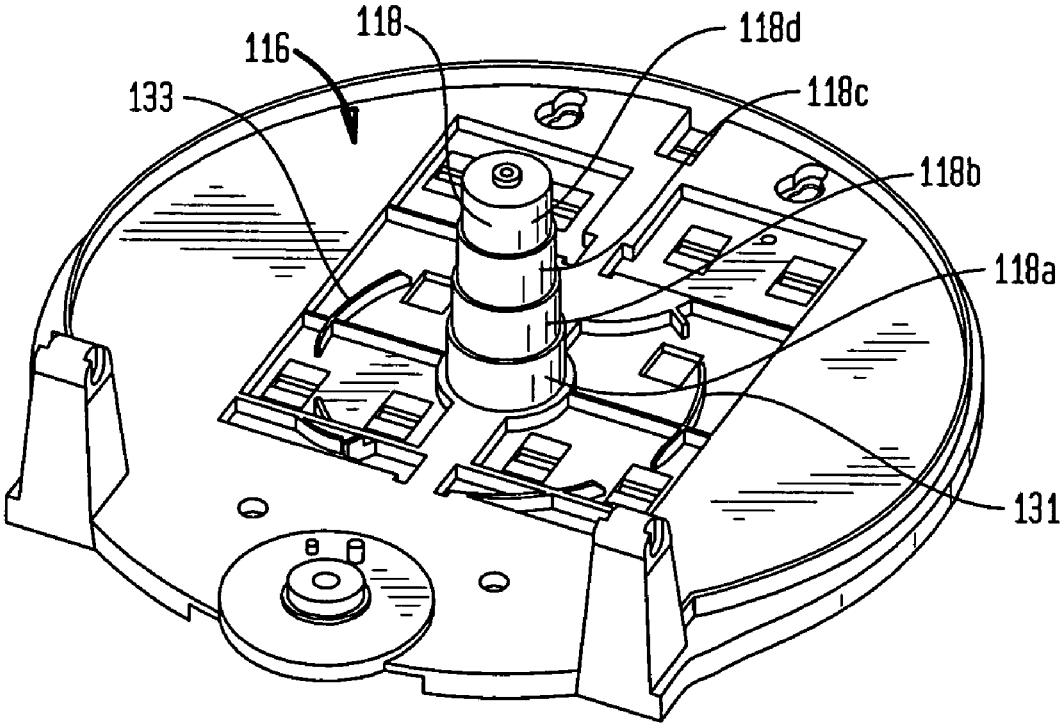
FIG. 19 is a top view in perspective showing a preferred mounting hub of the back plate of the dispenser of FIG. 11.

Plate 116 also preferably includes a plurality of curved ribs such as ribs 131, 133 (FIG. 19) for spring release arms 130, 132 and from plate 116 so that they will not bend against plate. As is also shown in FIG. 19, mandrel 118 also includes a stepped profile with segments 118*a*, 118*b*, 118*c*, 118*d* to reduce friction or binding between mandrel 118 and cylindrical support 119.

Figure 11:
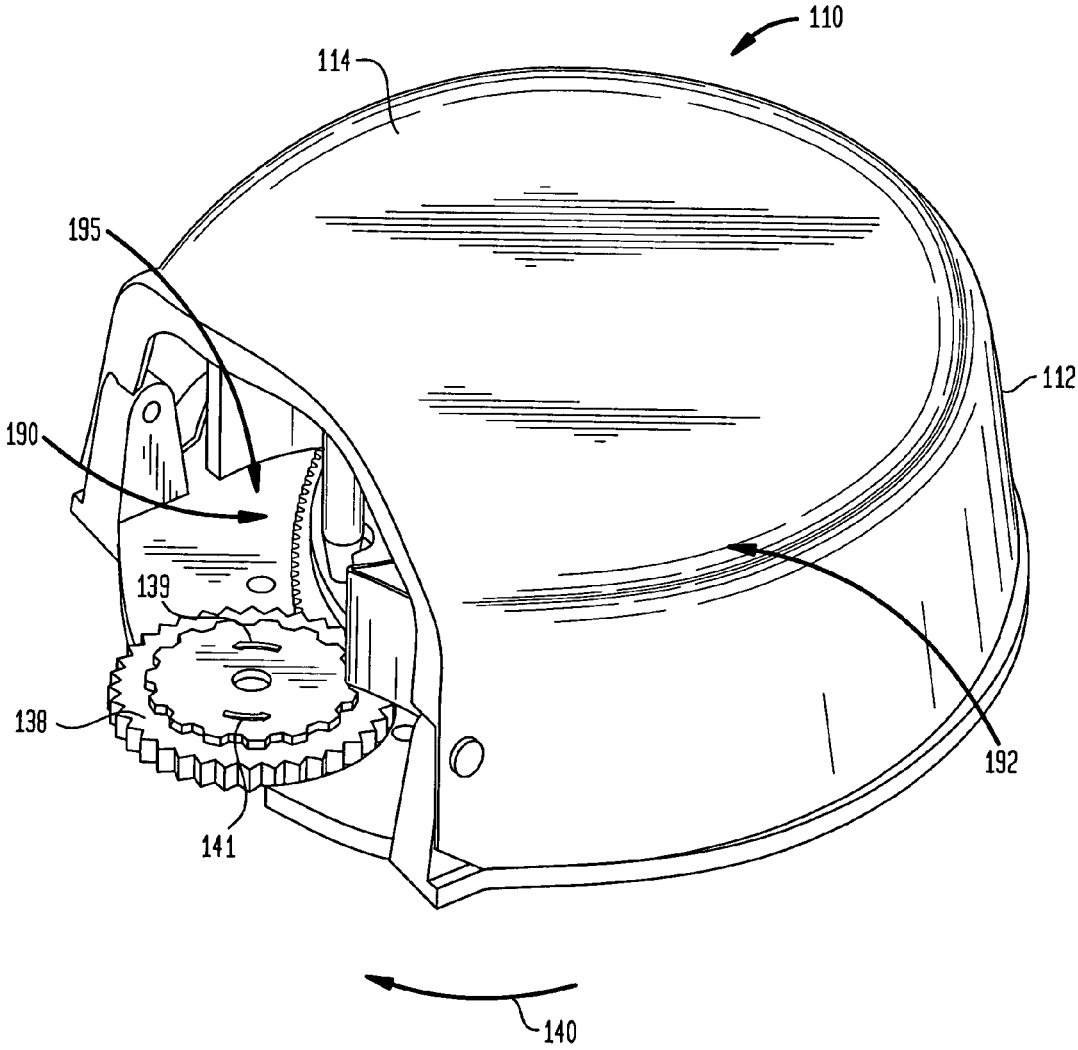
FIG. 11 is a view in perspective of a second embodiment of the inventive dispenser.
Figure 18:
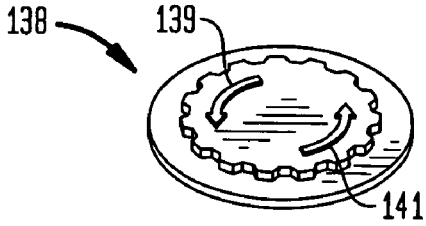
FIG. 18 is a perspective view of a preferred manual advancing wheel of the dispenser of FIG. 11.

A still further feature is shown in FIGS. 11, 12 and 18 wherein the face of wheel 138 is provided with a pair of directional arrows 139, 141 to show the direction of rotation of the wheel to manually advance turret 120 when necessary in order to dispense more product. Preferably, the arrows project upwardly away from the adjacent surface 0.010 inches or so.

Most preferably, the inventive dispenser is made from injection-molded parts which reduce the need for additional hardware and reduce or avoid the need for molding or drilling holes, especially in areas which might have relatively high molded-in stress such as at the base of cylindrical support 119.

Referring to FIGS. 14-17, it is seen that turret 120 includes a mounting wheel 121 with a plurality of molded-in directional shelves such as shelves 121*a*, 121*b* and 121*c* which project along dispensing direction 140. The shelves are provided with cavities such as cavities 121*d*, 121*e*. A retaining plate 123 includes a plurality of L-shaped, molded-in brackets 123*a*, 123*b* and so forth provided with projections 123*c*, 123*d* and so forth. The brackets, shelves, projections and cavities cooperate to secure retaining plate 123 to mounting plate 120 in order to secure springs 164*a*, 164*b*, 164*c*, 164*d* of release arms 130, 132, 134 and 136 to the turret. As will be appreciated from the illustrations, wheel 121 and plate 123 are thus lockable to each other by relative rotation in dispensing direction 140. In order to unlock the plates, their relative motion must be opposite the direction of rotation in normal operation such that in normal use, separation does not occur. That is to say, mounting plate 121 needs to be rotated counterclockwise (191, FIG. 14; 148, FIG. 11) with respect to plate 123 in order to separate them.

Figure 14:
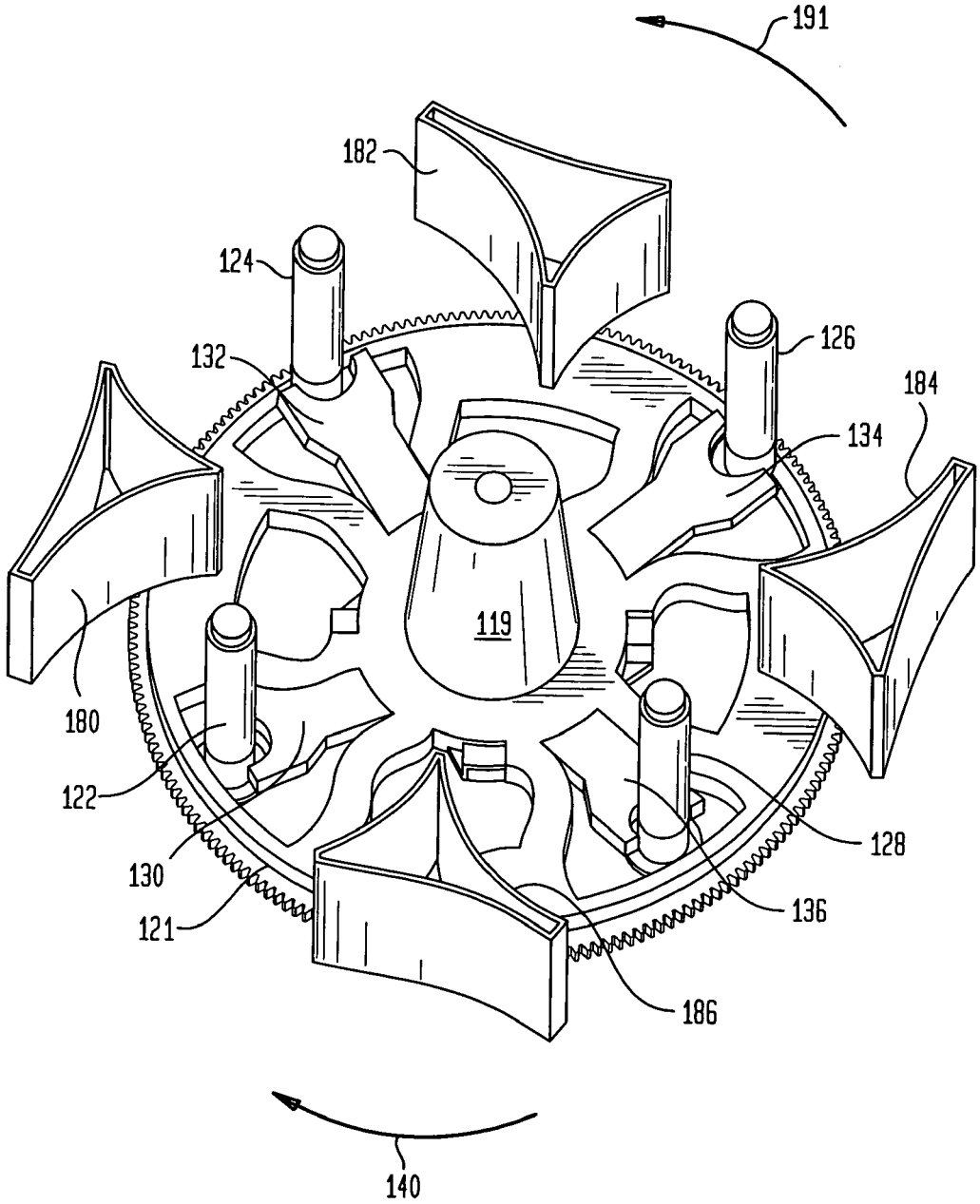
FIG. 14 is a top view in perspective of the turret assembly of the dispenser of FIG. 11.

FIG. 20 shows a unitary member 281 defining sequestering plates 280, 282, 284 and 286 having generally the configuration and blocking functions of plates 180-186 of FIGS. 12, 14 and 15. Member 281 is mounted on a turret 220 which is then placed in a dispenser such as dispenser 10 or 110 as described above.

Figure 21:
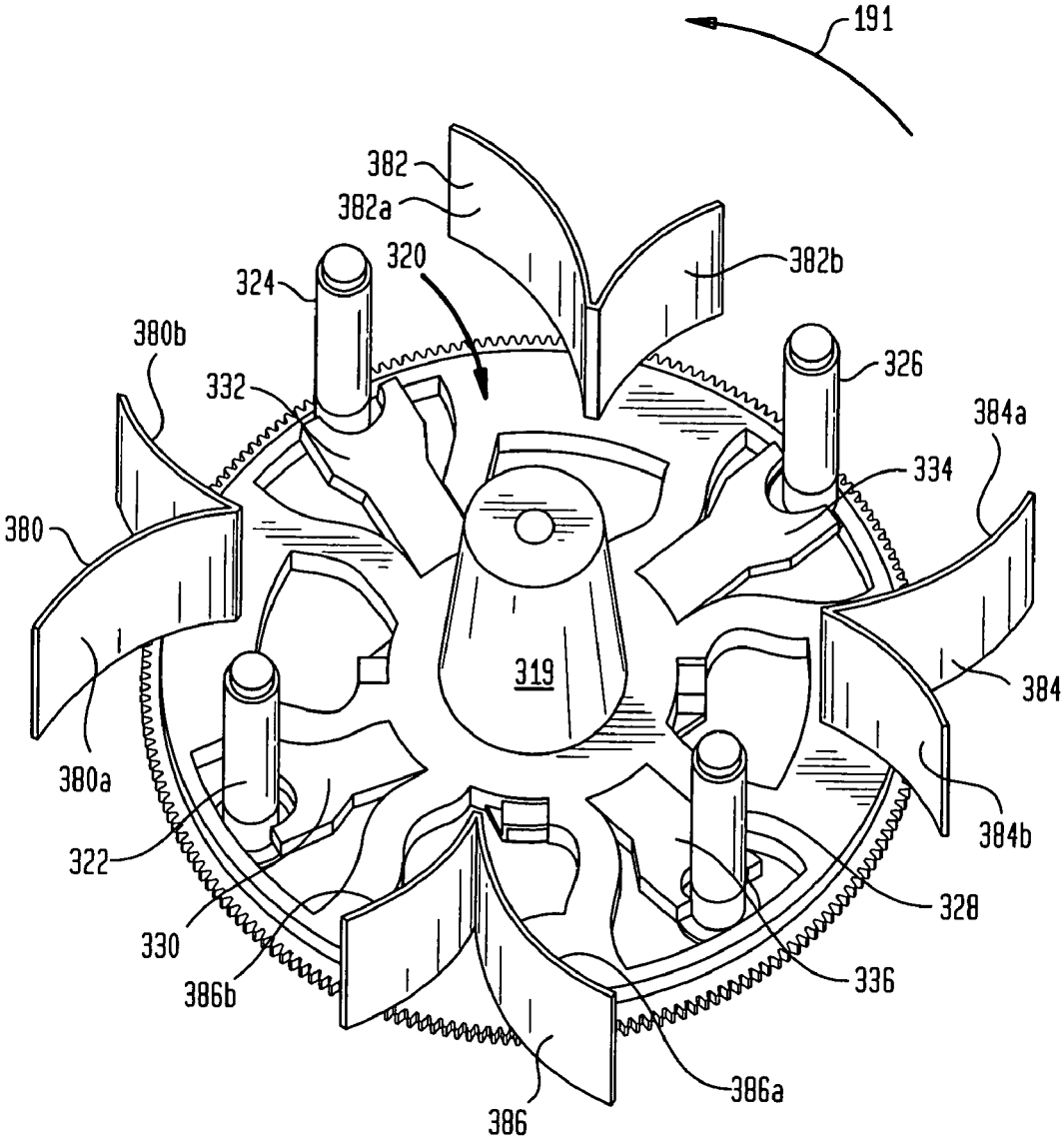
FIG. 21 is a top view in perspective of a preferred construction of the turret assembly of the inventive dispenser. The construction shown in FIG. 21 may be used in connection with the other components of the dispenser shown in FIGS. 1 through 9 in connection with a first embodiment of the inventive dispenser or the construction shown in FIG. 21 may be used in connection with the other components shown in FIGS. 10 through 18 in connection with a second embodiment of the inventive dispenser.

FIG. 21 shows a preferred construction of a turret 320 for use in connection with the inventive dispenser.

Turret 320 has a cylindrical support 319 for mounting the turret on the mandrel of the back plate. There is also provided four sleeved spindles, spindle 322, spindle 324, spindle 326, and spindle 328. Each sleeve spindle has a release arm such as release arms 330, 332, 334, and 336 associated therewith. Operation of the release arms is appreciated from the discussion above with respect to the corresponding parts of dispenser 10 and the corresponding parts of dispenser 110.

Turret 320 includes a plurality of sequestering members 380, 382, 384, and 386 associated respectively with spindles 322, 324, 326 and 328. Each of the sequestering members includes first and second panels as is shown in FIG. 21.

That is to say, sequestering member 380 has curved panels 380*a* and 380*b*, while sequestering member 382 has panels 382*a* and 382*b*. Sequestering member 384 has panel 384*a* and 384*b* while panel 386 has panel 386*a* and 386*b*. The curved panels are joined where the sequestering members are mounted on turret 320 and flare outwardly from that point away from each other as shown in FIG. 21. The sequestering members are thus configured and disposed in order to hinder access to the rolls of tissue disposed on the spindles until the spindles are in the dispensing position. That is to say, sequestering members 380, 382, 384, and 386 are adapted to hinder access to a roll not in the dispensing position as tissue is dispensed from the inventive dispenser.

Figure 22:
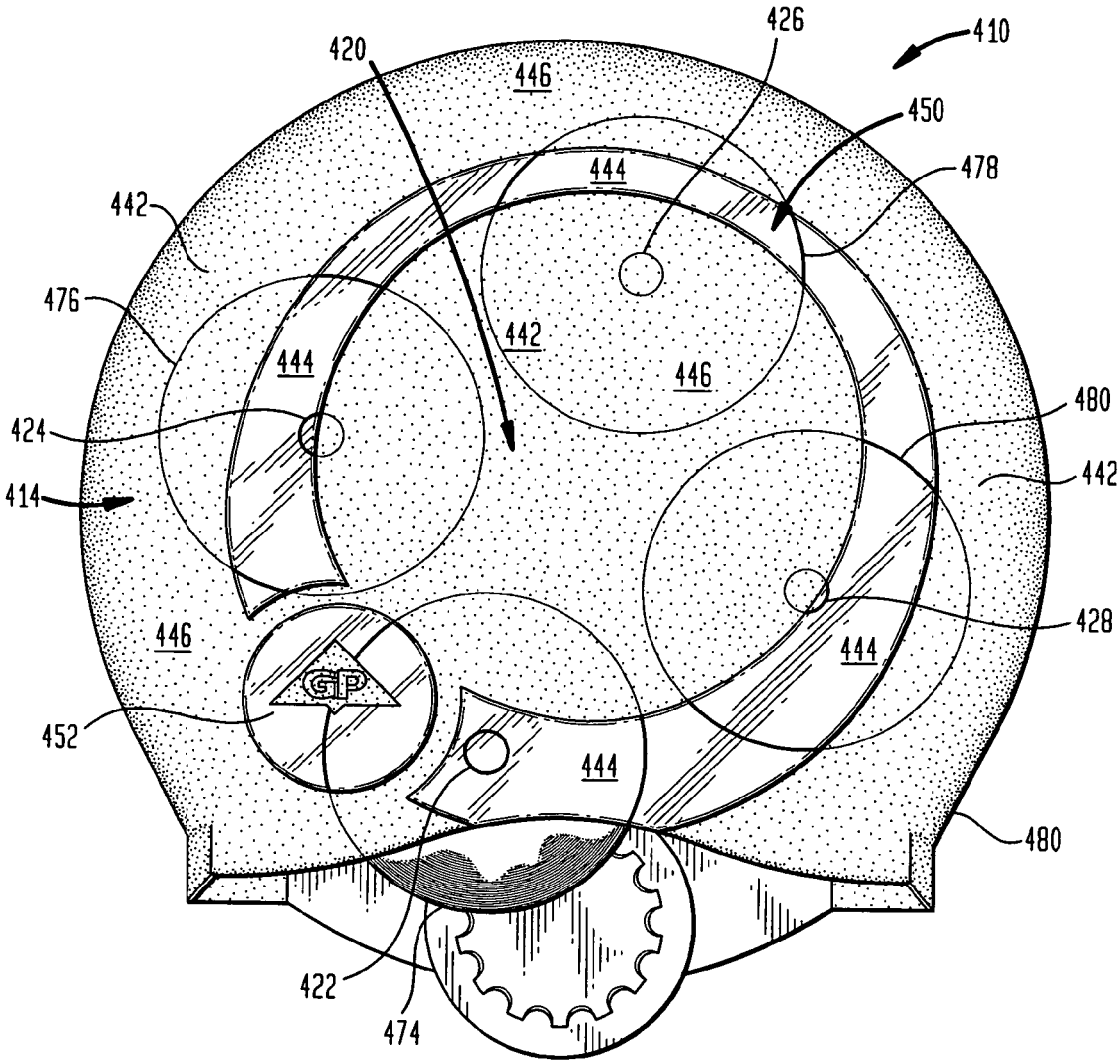
FIG. 22 is a schematic front view of a dispenser of the invention with a front cover having relatively transparent areas through which tissue roll inventory may be observed.

FIG. 22 shows yet another embodiment 410 of the inventive dispenser, wherein the housing is at least partially transparent so that tissue inventory may be observed. Dispenser 410 includes a turret 420 as noted above in connection with other embodiments wherein the turret has four spindles 422, 424, 426 and 428. Mounted on the turret is a plurality of tissue rolls 474, 476, 478, and 480. Note that roll 474 is in the dispensing position. It will further be appreciated from FIG. 22 that dispenser 410 has an outer housing front cover 414 made of plastic. Preferably cover 414 is integrally formed by way of injection molding of a thermoplastic resin composition including an acrylic resin (poly(methyl methacrylate) for example) or polycarbonate resin, or the like such that cover 414 has a unitary structure.

Cover 414 has a front 442 provided with polished areas 444 and textured areas 446. Preferably cover 414 is made from a transparent or lightly pigmented resin composition such that polished or smooth areas 444 are relatively transparent and textured areas 446 are translucent or relatively opaque depending on desired effect. In the preferred embodiment shown the polished areas define an arcuate region 450 extending substantially around the entire periphery of turret 420. Preferably the polished transparent area is adapted to allow viewing of the tissue area at each of spindles 422, 424, 426 and 428. This may be accomplished by having an arcuate structure extending over about 300 degrees or more of a circular turret, for example as is shown in FIG. 22. Smooth or polished areas can be provided by polishing the mold, while textured areas can be produced by texturing the surface of the mold by way of sandblasting, vapor honing or any other suitable technique.

For purposes of illustration, the smooth (polished), relatively transparent areas 444 of cover 414 are shown in oblique lines, while the textured areas 446 are stippled.

There is optionally provided a logo area 452 conveniently achieved by way of molding in the logo with a textured suface while molding the rest of the logo area with a polished mold surface. In order to produce a 3-dimensional appearance for the logo, it has been found suitable to use an embossment depth or molded in depth of about half that of the cover, i.e. for a 120 mil thick cover, it has been found that a suitable molded in depth for the logo is about 60 mils, that is to say the cover is about half thickness in the textured area of the logo.

Thus, there is provided means for simultaneously viewing roll inventory on at least two spindles of the dispenser through the front cover of the dispenser; optionally wherein relatively transparent area of the front cover includes a plurality of discrete relatively transparent areas. The relatively transparent area of the front cover is adapted and positioned to facilitate simultaneous viewing of roll inventory on all of the spindles of the dispenser disposed in a position other than the dispensing position. It is not necessary to view the inventory of the spindle in the dispensing position through the front cover since the spindle is exposed in any event; however in a preferred construction the spindle inventory of the spindle in the dispensing position is also simultaneously viewable with the inventory of the other spindles. Preferably, a relatively transparent area of the front cover is ring-shaped, wherein the ring-shaped area is sized and positioned to facilitate simultaneous viewing of roll inventory on at least two spindles of the dispenser.

While the invention has been described in connection with a preferred dispenser, modifications within the spirit and scope of the invention will be readily apparent to those with skill in the art. In view of the foregoing discussion, relevant knowledge in the art and references discussed above in connection with the background of the invention, further description is deemed unnecessary.

What is claimed is:

1. A gravity-feed tissue roll dispenser for a plurality of tissue rolls comprising:

(a) a housing with a dispensing opening for allowing access to tissue contained in the dispenser;

(b) a supply turret with a plurality of spindles for mounting a plurality of tissue rolls for dispensing;

(c) means for rotatably mounting the supply turret in the housing;

(d) stop means adapted for securing a loaded spindle in a dispensing position, the stop means being responsive to depletion of the loaded spindle so as to allow rotation of the turret upon depletion of a roll of tissue mounted thereabout; and (e) a plurality of sequestering members mounted on the turret in such a manner as to move with the turret and relative to the housing, each sequestering member being associated with a respective one of the spindles, each sequestering member being adapted to cooperate with the housing in order to hinder access to a tissue roll on its associated spindle until the spindle is in the dispensing position.

2. The tissue roll dispenser according to claim 1, wherein the means for rotatably mounting the supply turret in the housing are configured to mount the turret about a center of rotation such that a vertical line through the center of rotation of the turret defines a biasing sector of the dispenser and the spindles rotate between upper and lower positions, the dispenser also having a dispensing sector adjacent the biasing sector, and wherein the dispensing position is elevated with respect to a tower limit of travel of the spindle upon rotation of the turret and wherein further the turret and stop means are configured such that when a loaded spindle is secured in the elevated dispensing position: (i) at least two spindles are in the biasing sector of the dispenser and (ii) the number of spindles in the biasing sector loaded with a full roll of tissue is equal to or greater than the number of other spindles in the dispensing sector loaded with a full roll of tissue, such that when the dispenser is fully loaded with a plurality of like tissue rolls, depletion of a roll in the elevated dispensing position distributes the weight of tissue in the dispenser so as to bias the turret in a dispensing direction.

3. The tissue roll dispenser according to claim 1, wherein the sequestering members comprise curved plates.

4. The tissue roll dispenser according to claim 1, wherein the sequestering members are discrete components.

5. The tissue roll dispenser according to claim 1, wherein the sequestering members are injection-molded as part of a unitary structure.

6. A method of dispensing tissue comprising:

(a) disposing a plurality of tissue rolls in a dispenser comprising:

(i) a housing with a dispensing opening for allowing access to tissue contained in the dispenser;

(ii) a supply turret with a plurality of spindles for mounting a plurality of tissue rolls for dispensing;

(iii) means for rotatably mounting the supply turret in the housing;

(iv) stop means adapted for securing a loaded spindle in a dispensing position, the stop means being responsive to depletion of the loaded spindle so as to allow rotation of the turret upon depletion of a roll of tissue mounted thereabout;

(v) a plurality of sequestering members mounted on the turret in such a manner as to move with the turret and relative to the housing, each sequestering member being associated with a respective one of the spindles, each sequestering member being adapted to cooperate with the housing in order to hinder access to a tissue roll on its associated spindle until the spindle is in the dispensing position; and (b) withdrawing tissue from the dispenser.

* * * * *